US005558241A

United States Patent [19]

Huffstutler, Jr. et al.

[11] Patent Number: 5,558,241

[45] Date of Patent: Sep. 24, 1996

[54] CRYOTRANSPORT CHAMBER

[75] Inventors: M. Conrad Huffstutler, Jr., Burnsville; Patrick E. Meacham, Lakeville; Mark W. Wallace, Minneapolis; Carl R. Nyberg, Bloomington, all of Minn.

[73] Assignee: Temp Top Container Systems, Inc., Edina, Minn.

[21] Appl. No.: 178,189

[22] Filed: Jan. 6, 1994

[51] Int. Cl.[6] ..... B65D 6/16

[52] U.S. Cl. ..... 220/1.5; 220/4.31; 220/6; 220/682

[58] Field of Search ..... 220/4.28, 4.31, 220/4.32, 1.5, 4.33, 682, 691, 6

[56] References Cited

U.S. PATENT DOCUMENTS

| | | | |
|---|---|---|---|
| 886,530 | 5/1908 | Mestemacher . | |
| 1,931,397 | 5/1931 | Smith | 217/43 |
| 3,266,656 | 8/1966 | Kridle | 220/4.33 |
| 3,854,269 | 12/1974 | Hancock . | |
| 3,940,007 | 2/1976 | Griffiths | 220/4.33 |
| 3,974,616 | 8/1976 | Beckley | 220/682 |
| 3,989,157 | 11/1976 | Veenema | 220/4.33 |
| 4,000,827 | 1/1977 | Emery | 220/1.5 |
| 4,165,024 | 8/1979 | Oswalt et al. | 220/4.28 |
| 4,221,302 | 9/1980 | Kupersmit | 220/4.31 |
| 4,456,142 | 6/1984 | Burling | 220/4 |
| 4,591,065 | 5/1986 | Foy | 220/7 |
| 4,673,087 | 6/1987 | Webb | 220/4.33 |
| 4,693,386 | 9/1987 | Hughes et al. | 220/1.5 |
| 4,809,851 | 3/1989 | Oestreich, Jr. et al. | 206/599 |
| 4,936,615 | 6/1990 | Moore | 294/68.1 |
| 5,070,577 | 12/1991 | Bonneville et al. | 16/260 |
| 5,161,709 | 11/1992 | Oestreich, Jr. | 220/6 |
| 5,204,149 | 4/1993 | Phenicie et al. | 220/1.5 |
| 5,236,099 | 8/1993 | Fties et al. | 220/1.5 |
| 5,253,763 | 10/1993 | Kirkley et al. . | |
| 5,263,339 | 11/1993 | Evans . | |

FOREIGN PATENT DOCUMENTS

| | | | |
|---|---|---|---|
| 87978 | 3/1992 | Japan | 220/4.28 |
| WO94/0133 | 1/1994 | WIPO . | |

*Primary Examiner*—David Scherbel
*Assistant Examiner*—Tony G. Soohoo
*Attorney, Agent, or Firm*—Kinney & Lange, P.A.

[57] ABSTRACT

A multi-use, knock-down, fully-insulated chamber for the transport of frozen, heated or cooled contents having pivotable sides with interlocking edge retainers for transfer of hoop stresses and wrinkle-type, flexible connective bands to guide sides between their erected and knockdown positions.

19 Claims, 6 Drawing Sheets

Fig. 5a
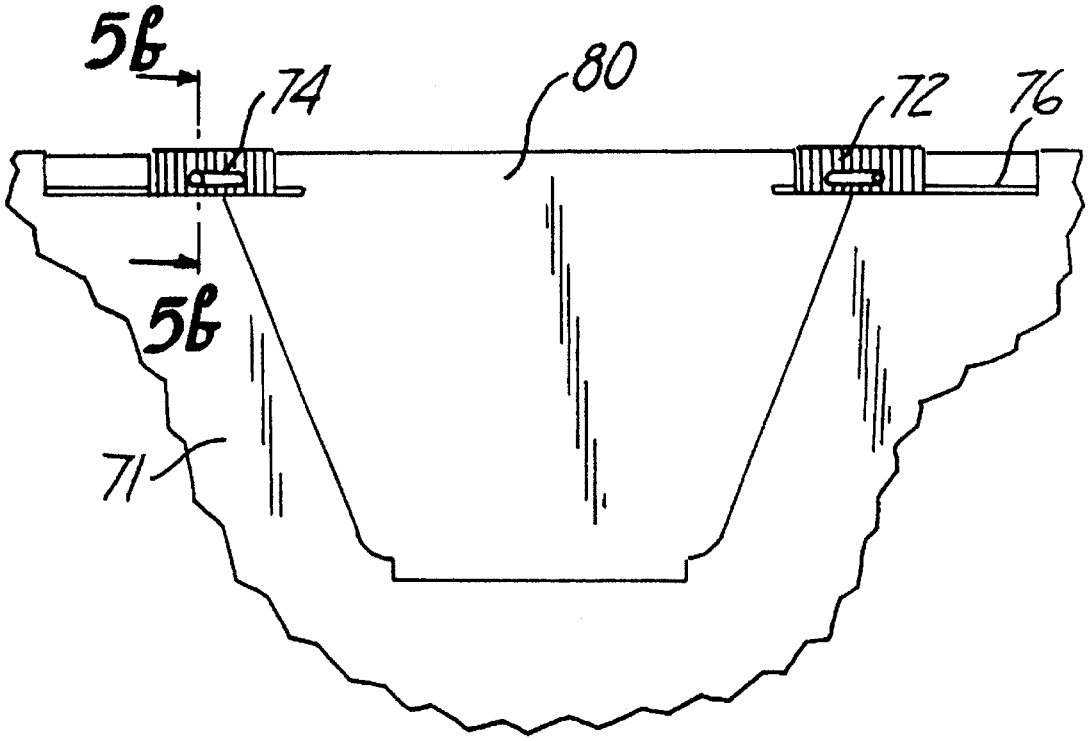
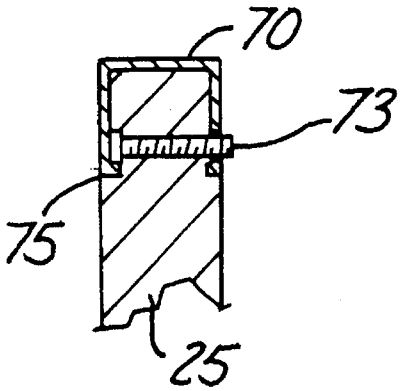
Fig. 5b

CRYOTRANSPORT CHAMBER

BACKGROUND OF THE INVENTION

1. Field of the Invention

This invention is an improved, reusable insulated chamber for transport and handling of frozen, cold or cool bulk fluids, solids, packaged foods, and liquid cell-culture media.

2. Description of Related Art

Since the invention of 2-piece, molded styrene foam ice chests for preservation of picnic foods, many foods, beverages and industrial items have been transported in such simple insulated closed containers. Because the insulating characteristics of many types of closed-cell polymer foams are excellent for maintaining temperatures in the range of 0° to 10° C., with water ice in a separate section or sealed bag, there has been little need for innovation in the field of small, insulated transport containers, i.e., volume of approx 0.05 to 0.2 cubic meter. Special refrigerated and cryocooled truck bodies have typically been used for transport of larger items such as beef halves and larger quantities of fluid such as 10000 liters of liquid nitrogen. There seems to have been little focus upon the problem of preserving pallet-sized quantities of valuable, perishable goods during one or more transport stages from the original packing/freezing plant to the display cooler in a retail outlet or to an institutional food-preparation area.

SUMMARY OF THE INVENTION

One object of this invention is a system of robust, load-transfer edgelok couplings for abutting, pivotable sidewalls of re-usable shipping containers. The edgelok couplings of this invention, which include mating tang and yoke elements, are prepared with matching latch features which provide for positive engagement of the sidewalls in the erected position. One result of full, positive engagement of the tang and yoke elements is the ability to transfer lateral loads and outward forces resulting from the contents of the container.

A further object of this invention is a system of low-air-inspiration edgelok couplings for abutting, insulated top and sidewalls of a reusable, insulating, enclosed transport chamber for hot or cold food products. Preventing access of humid air to cold or frozen contents is of significant benefit in retarding warmup and thawing of packaged or bulk food products being transported.

Another object of this invention is a flexible, pleated guide element which retains and limits the lateral movements of the swinging-pivoting sections of the container during travel from the erected to knock-down orientations.

Still another object of this invention is a set of pivotable, trapezoidal gates in the top portion of the erected sidewalls to facilitate easier loading and unloading of loose bulk items with a scoop or manual pickup of smaller containers from the lowest layer. Ease of loading and unloading of small heavy packages from the bottom zones of the container is important for compliance with OSHA regulations for lifting in a bent-over posture.

Another object of this invention is to provide slidable, latching elements to secure the gates in their erected position. Both ends of the upper rim of the trapezoidal gates are fitted with slidechannel latches which are attached to gate portion and slidable to lock the nested, erected gate securely into the adjacent cutaway panel.

Another object of this invention is to provide panels and gates with one or more sealed access ports for inserting probes for monitoring internal temperature distributions and taking bulk product samples for food or customs inspections.

An additional object of this invention is a set of interconnected drain paths and channels formed integral with the inside faces of the sidewalls and top face of the base which terminate in a enclosable, drainable reservoir pocket in the base. These features are designed to prevent any liquid condensate formed on the inner surfaces from accumulating in amounts large enough to contaminate edible or pharmaceutical contents. A second purpose of the drain paths is to provide reliable, prompt drainage of cleaning/disinfection fluids when the container is being scrubbed after each use. Compliance with all sanitary packaging and transport regulations is obligatory for foodstuffs such as ice cream, bulk meat/carcass sections, packaged/processed food items, bulk fish/shrimp/poultry, etc.

Still an additional object of this invention is a foldable, slidable, insulated cover which seals the enclosed space against air inspiration and heat exchange with the environment. The elastomer sealwing flanges of the cover emit a distinctive sound as the cover is pushed downward into the enclosed volume and into contact with the top of the contents, thereby displacing the air. This unique feature gives audible confirmation that the contents are tightly sealed against air infiltration.

BRIEF DESCRIPTION OF THE DRAWINGS

FIG. 1 also shows the location of additional detail views of edgelok couplings and slidelatches.

FIG. 4(*a*) shows a 90-degree pliolink coupling between the superbase and the sidewall in erected (left) and knockdown orientations (right). FIG. 4(*b*) shows erected (left) and pivoted (right) positions of a 180-degree pliolink coupling between a gate and a cut-out zone of the sidewall.

FIG. 5(*a*) shows a front view of a pair of slidechannel latches to secure gate sections in the erected position. FIG. 5(*b*) shows a section view of the slidelatch taken through the retainer pin; the relationship of the pin extension and the retention slot is evident. This section also shows the flanges of the slidelatch engaged into formed grooves in the gate and cut-out zone.

BEST MODE EMBODIMENTS

As can be seen from FIGS. 1–7, the insulated, knock-down container of this invention includes the following elements:

Base (10, FIGS. 1, 7), A rectangular component with a thermally insulated upper face adapted to drain a puddle of liquid from its center toward the nearest corner and into a drainable pocket reservoir, fitted with downward-faring bottom standoff elements at each corner to allow passage of the forks of a lifting device under the base and edge-engagement socket features along 2 lateral and 2 transverse edges;

Superbase (20). A set of short, insulated vertical superwall elements including 2 transverse and 2 lateral elements, all oriented substantially perpendicular to the upper face of the base and coupled rigidly together at their abutting vertical edges, all their bottom edges having minor image projection features adapted to engage with socket features of the base;

Sidewalls (25). A set of pivotable, insulated wall elements including 2 transverse and 2 lateral sidewalls, S1 and S2 respectively, all oriented substantially perpendicular to the upper face of the base when erected, coupled rigidly together at their abutting vertical edges, in the erected position, by edgelok couplings, sized to permit first opposing pair to pivot inward toward each other over an angle of 90 degrees inside the other pair still in the erected orientation, second opposing pair also pivotable inward toward each other over an angle of 90 degrees after the first pair is already in the knock-down position, supported and guided in pivoting movements from the erected position to the knock-down position by pliolink plicated couplings; and Cover (30, FIG. 6). A removable flexible insulating structure sized for a tight-fitting vapor seal inside the lateral and transverse sidewalls at any vertical position above the superbase for the purpose of preventing heat transfer to the contents by radiation, conduction, convection and inspiration of air from the environment, which can be frictionally secured in contact with the contents at any level within the height of the sidewalls.

Figure 1:
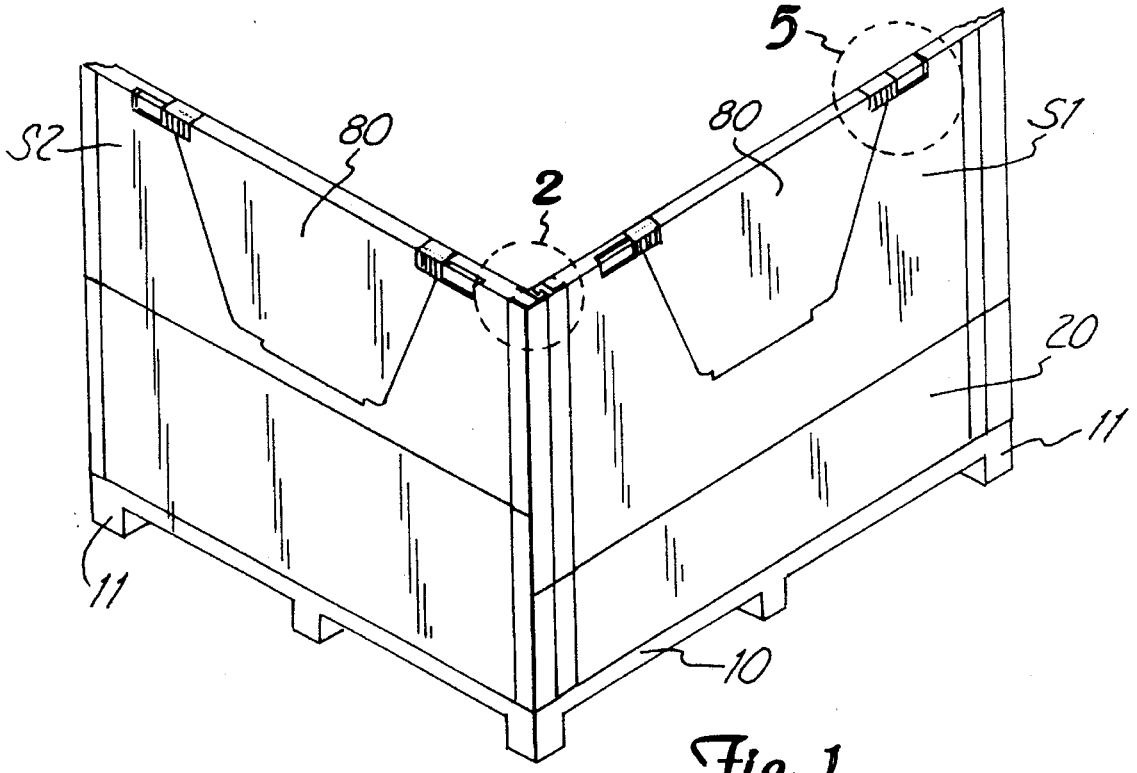
FIG. 1 shows an isometric ,view of abutting, pivotable sidewalls fitted with load-transfer edgelok couplings, i.e., tangs on one panel which interdigitate with matching yokes on the other. This figure also indicates relative size and placement of sidewall gates to facilitate easy manual loading and unloading.
Figure 2:
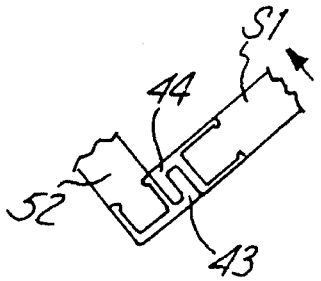
FIG. 2 shows a sectional plan view of interlocking, load-transfer features of the tang and yoke components of a typical edgelok coupling.
Figure 3A:
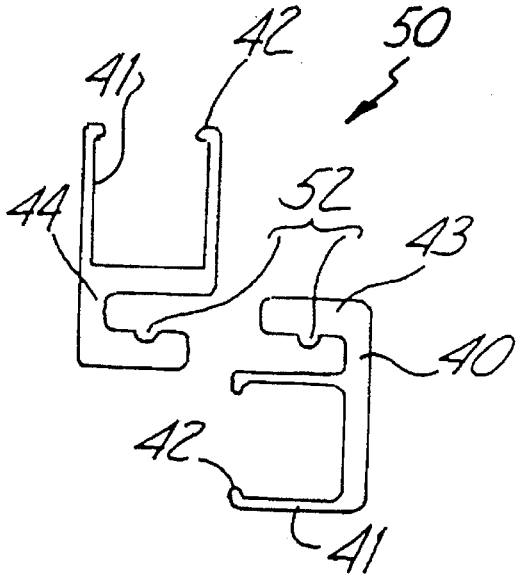
FIG. 3 shows examples of several embodiments of tang and yoke elements of the edgeloks. Symmetric posilatch features are shown in FIG. 3(*b*) while asymmetric posilatch features, including a tapered tang and a tang with projections on one side are shown in FIGS. 3(*c*) and 3(*a*) respectively.
Figure 3C:
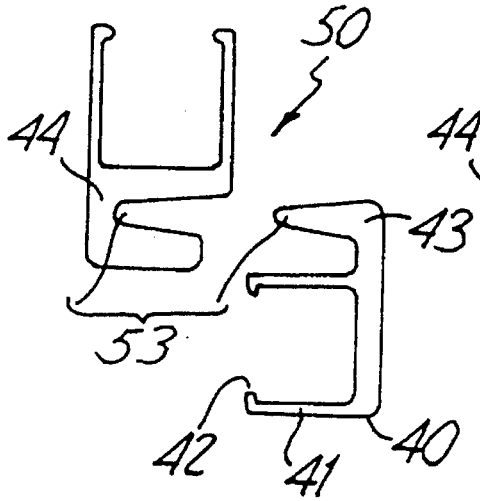
Figure 3B:
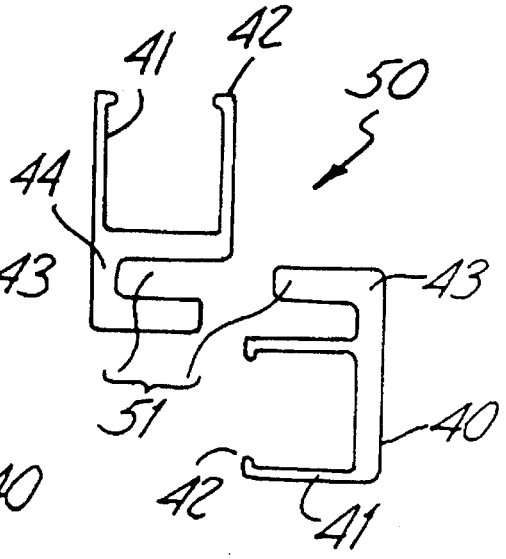
Figure 4A:
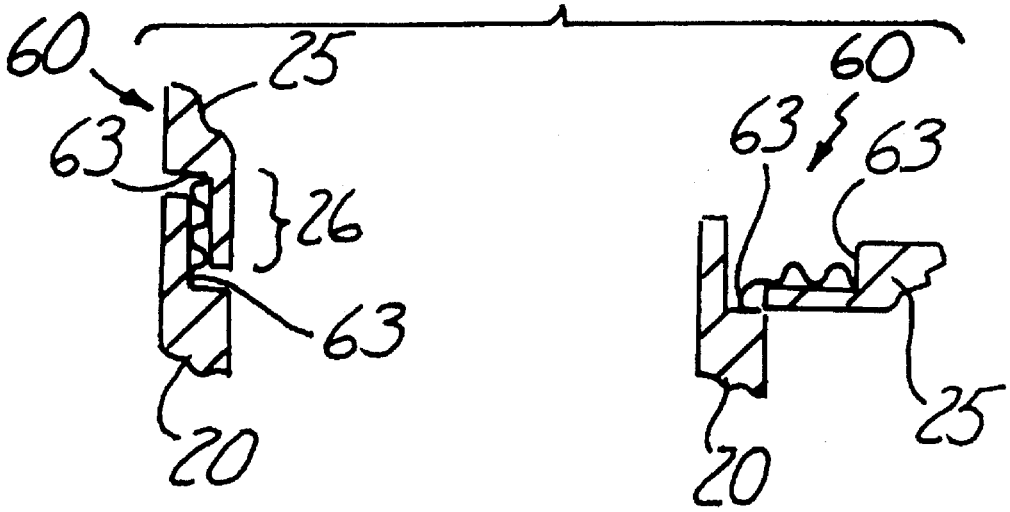
FIG. 4 shows sectional views of alternative 90- and 180-degree pliolink couplings.
Figure 4B:
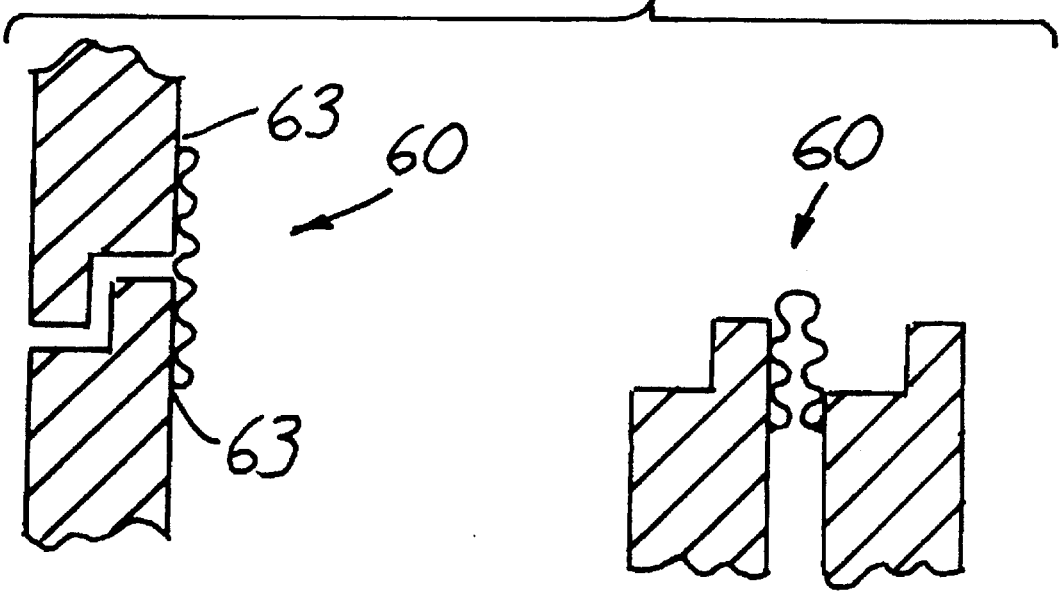
Figure 6:
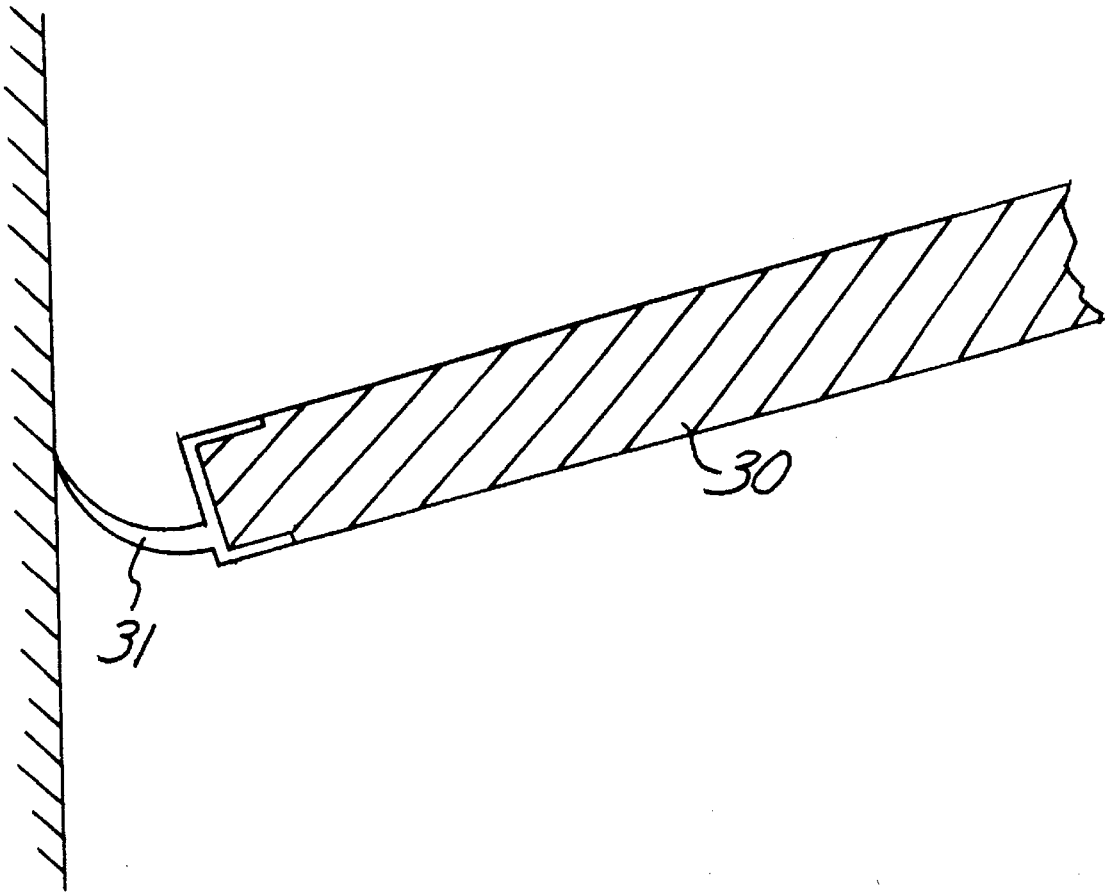
FIG. 6 shows a sectional detail view of the cover and compliant sealwings for an insulated container partially-loaded with cold product. The sealwings are long enough to permit tilting the cover as is brought into contact with contents which do not completely fill the chamber. As can be seen, the tapered elastomer sealwings extend 20–50 mm beyond the edge of the cover and are performed with an upward curved in their tip zone.
Figure 7:
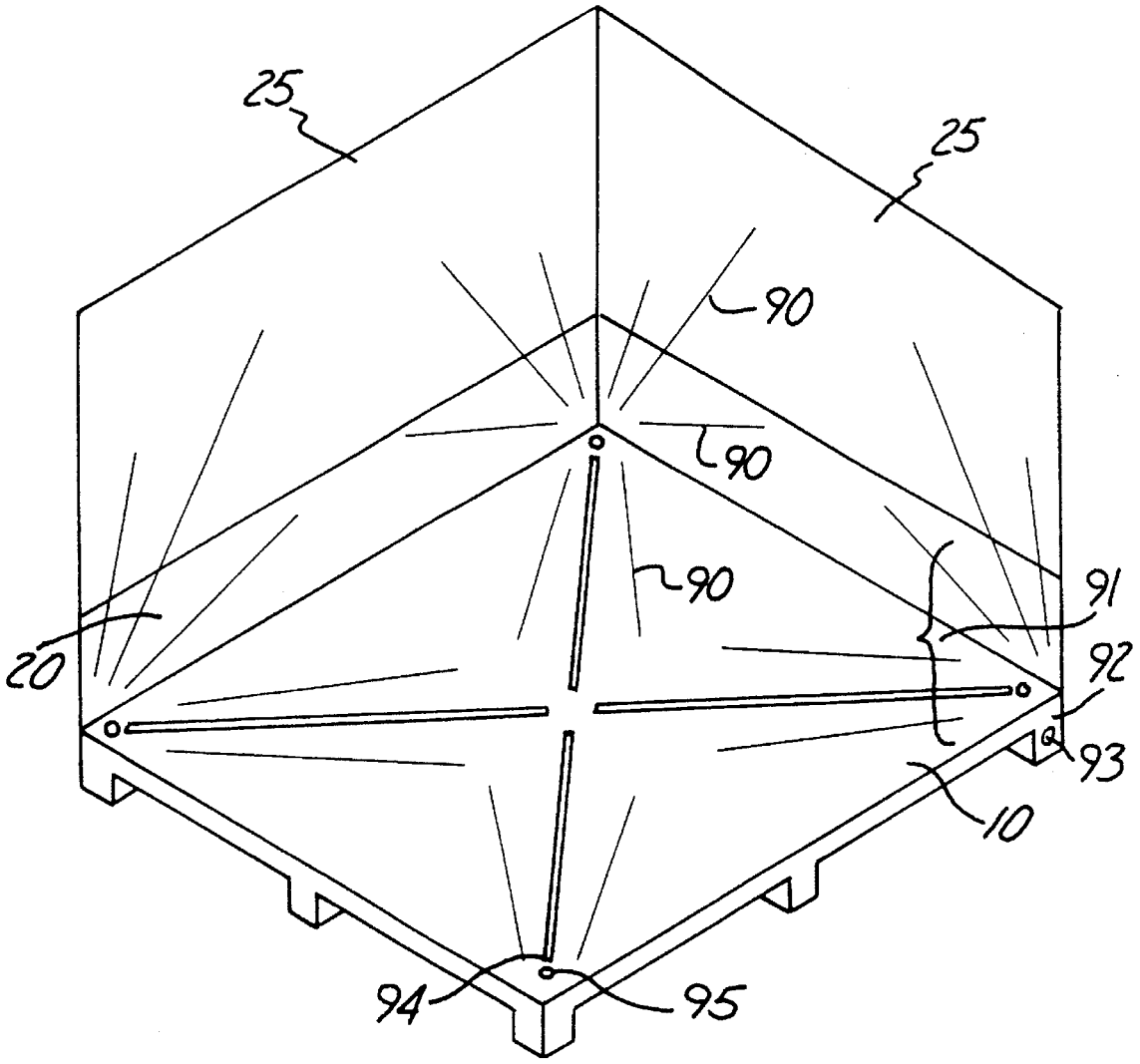
FIG. 7 shows a partial isometric view of the inside of a chamber with two walls in the erected position. From this perspective, than orientation and interconnection of dewchannels of the sidewalls and superwalls into a functional array is clearly seen. The orientation of base dewchannels to drain condensate toward the corner pockets can be easily visualized.

Sealwings (31, FIG. 6). Compliant, curved elastomer sealwings extending from the cover edges make a positive gas seal between the cover and the inner surfaces of the sidewalls. The specific tapered form, length, thickness and physical properties of the sealwings causes them to emit a distinctive sound as the cover is pushed downward from the top of the sidewalls until it is in light contact with the contents. This acoustic feature is related to the resonant frequency of the sealwing flaps as Strouhal vortices are shed from their trailing edges due to jets of air being expelled from the enclosed load cavity of the container. The pitch of the unique "whooshing" sound is of significant value to confirm that all the other seals of the container are tight, that air is in fact being expelled in response to displating the cover downward toward the contents and that all of the sealwings are in a dependable sealing relationship with the inner surfaces of the sidewalls.

Edgelok (40, FIG. 2) couplings of this invention serve to transfer hoop stresses between abutting, pivoting sidewalls of a container. Typically, edgeloks are formed from thermoplastics by extrusion-type processes and are attached along the entire length of all abutting sidewall edges. Edgelok pairs transfer loads and forces by means of mating yoke and tang features which come into an intertwined relationship when both adjacent panels are pivoted into their erected positions. To provide a secure lock to hold the sidewalls in their intertwined relationship, symmetric or asymmetric mating posilatch features are incorporated on selected faces of the tang and yoke.

Edgeloks are formed with a channel-type engagement feature 41 for attachment to the adjacent edges of the sidewalls; typically the engagement channel also contains attachment flanges 42 which mate with preformed grooves in the sidewalls and provide additional mechanical load transfer between the panel and the edgelok. Typically, the edgelok channel is a light interference fit with the mating, prepared vertical edges of the pivoting sidewalls and full-length edgeloks can be slid manually into position. Adhesives, conventional fasteners (e.g., pop rivets, screws, etc.) as well as bonding/welding methods can be used to provide additional strength and stiffness in the joint between the sidewall edge and the edgelok.

Posilatch elements (50, FIG. 3) function to maintain the erected sidewalls in full engagement while the chamber or container is being loaded or unloaded, i.e., to prevent accidental disengagement and spilling of the contents. A further benefit of the posilatch is to maintain the fully-engaged position of the tang and yoke under vibration, twisting and tilting during handling of a loaded container. The most significant benefit of the posilatch is to provide additional sealing against inspired air being drawn or pumped into the insulated space by "oil-canning" of the sidewalls during handling. Posilatch elements may be either symmetric or asymmetric with respect to the plane of intertwinement of the tang and yoke. The symmetric configuration 51 shown in FIG. 3(*b*) has greater seal area and is preferred for containers for heavy, cold loads. Asymmetric posilatch elements 52 shown in FIGS. 3*a* and 3*c* which are positioned at the zone of maximum compression between the tang and yoke, increase in engagement directly with increases in the force loading on the edgelok. The posilatch elements 52 shown in FIG. 3(*a*) include a semi-circular posilatch extension on latch extension 43 and a semi-circular posilatch groove in latch channel 44. When the edgelok coupling assembly 40 is connected, the semi-circular posilatch extension fits into the posilatch groove to securely connect the first and second edgeloks of the edgelok coupling assembly 40. The posilatch elements 53 shown in FIG. 3(*c*) are tapered with a circular posilatch extension on the end of latch extension 43. A circular posilatch groove is provided at the base of latch channel 44. When the edgelok coupling assembly 40 is connected, the circular posilatch extension fits into the posilatch groove to securely connect the first and second edgeloks of the edgelok coupling assembly 40.

Pliolinks (60, FIG. 4) are plicated elastomer couplings which serve to guide and control pivoting motions of sidewalls and gates 80 of knock-down containers of this invention. Pliolinks are elongated strips of serpentine-pleated elastomer 61 adapted for attachment to edges of pivoting, insulated sidewall or gate panels. The typical thickness range of sidewall panels is 20–80 mm. The width, elastomer stiffness, and pleat compliance of the specific pliolink are balanced to prevent tensile overstress and permanent deformation-set of the elastomer strip during container storage for an extended period at room temperature in the knock-down position, i.e., pivoted 90 degrees from the erected position.

For 90 degree pivoting of sidewalls, the pliolink strip is attached to preformed step zones 26 of the superbase and the abutting sidewall. The entire width of the pliolink strip may be reinforced by encapsulating a centered fabric layer i.e., woven, knit, or non-woven fibers such as amide, imide, carbon, etc. The two lateral edges of the pliolink strip 63 may be buttressed with stiffening channels, strips or plates to prevent stress-concentration at points where the edges are secured to the panels by fasteners such as screws or rivets. Alternately, the edges of the pliolink strip may be formed into a unique T-shaped rib which snaps with light interference into a mating groove formed in the edges of the parts to be coupled for pivotal movement. For additional strength, the T-rib embodiment lends itself to use of a liquid adhesive for permanent bonding of the pliolink into the pivotal elements. Sinewave-type pleats in the pliolink are formed by molding in conventional elastomers such as neoprene or by extrusion for TPE elastomers. For typical sidewalls, the undulating sine pleats of the pliolink are extruded from basic TPE material such as Kraton (tm) 1–5 mm thick, having a period in the range 5–20 mm and a peak-to-peak height of 8–20 mm.

Slidelatches (FIG. 5) are pairs of slidable channel elements which interconnect the top-edge portion of a pivoting gate with the top edges of adjacent cut-away openings 71. With both slidelatches in their first latched position, 72 the gate is secured across the opening; with both slidelatches in their second retracted position, the gate can be pivoted up to 180 degrees inward into the container. Channel-like slidelatch elements are moveable to and fro over a distance of 1–2 panel thicknesses and are retained laterally by a thru pin 73 which extends from the sidewall and engages an elongated slot 74 in the slidelatch. Slidelatches are retained against pivotal movement by an edge flange 75 which extends into a mating groove in the gate 76 and cut-away opening. The side walls of the channel of the slidelatch are thick enough to support low levels of externally- applied-inward force and load as might occur during handling or transit. The gate and cut-away are prepared with mating conical alignment pegs/sockets to assure that forces and loads arising from shifting of the contents are supported by the broad mating flanges of the gate and the cut-away opening. For a loaded container, the interdigitated pegs/sockets support distortional loads upon the sidewalls, and the purpose of the slidelatches is to maintain full engagement of the pegs with the sockets. Slidelatches may be prepared by extrusion of metals, alloys or polymers to the desired flanged-channel profile. Alternatively, they may be formed from alloys or polymers by rolling or drawing methods.

Dewchannels (90, FIG. 7) are drainage flow paths formed integral with the inner surfaces of the sidewalls, superbase and base upper face. During loading a erected container with cold products, when the cover is removed and the inner surfaces of the sidewalls, superbase and base are fully exposed to humid air, liquid condensate "dew" will form on all the cold surfaces that are below the air dew point. Typical paperboard packages for food or pharmaceuticals in contact with these surfaces will be wetted by dew and resulting capillary flows will transfer contaminants from the container surfaces and the environment into and onto the product. Frozen products, such as ice cream cartons in contact with the top face of the base, are particularly sensitive to contamination by accumulations of dew which form "puddles" on the base. An interconnected array of dewchannels 91 according to this invention provides a set capillary channels to purge surface dew from the base, superbase and sidewalls and draw the liquid residue into drainable pockets 92 below the four corners of the base. To allow continuous release of collected liquid dew from the base pockets, each pocket is fitted with a check valve 93 which assures egress of liquid and prevents entry of environmental liquids as might result from standing water on a loading dock exposed to rain.

The cover (30, FIG. 6) is a tight-fitting, insulated panel which prevents heat exchange and air inspiration between the contents and the environment. The edges of the cover are fitted with sealwings 31 which form a positive gas seal for the top of the enclosed load space. Sealwings are compliant, curved elastomer flaps which extend from the edges of the cover and are slightly deflected when they come a into contact with the inner surfaces of the sidewalls.

EXAMPLES OF ALTERNATIVE EMBODIMENTS

EXAMPLE 1

Alternative Forms, Sizes, Application Fields.

The knock-down insulated carriers of this invention can be prepared in a wide variety of sizes for many diverse purposes. A container with a 2- or 4-wheeled base, in the general form of a hand truck, would be useful in a hospital or restaurant. In certain cases, snap-on-type removable wheels and axles could be fitted to the container after it is unloaded from the transport trailer. A carrier with a manual lift bale or lift eye for engagement with a wheeled machine would be useful for galleys in a train or airliner. Likewise, a unique-form container shaped to nest into the hull contours of the loadbay of an aircraft would be useful for air shipments of perishable goods such as bulk seafood or pharmaceutical fluids. Indeed the knock-down insulated containers of this invention would be of significant value for transport of food and medical supplied to a war zone or natural disaster.

One major embodiment is in the form of pallet-type containers designed to be handled with a wheeled manual jack (one high) or a powered forklift (stacked two-high). Table 1 gives typical dimensional range

TABLE 1

Typical Size Ranges, Pallet-Style Containers

| Feature | Parameter(s) | Size Range, Sl units |
|---|---|---|
| S1, S2 | length | 0.8 < meters < 1.5 |
| sidewalls | height | 0.2 < meters < 1 |
| | thickness | 20 < mm < 80 |
| superbase | length | 0.8 < meters < 1.5 |
| walls | height | 60 < mm < 300 |
| | thickness | 20 < mm < 100 |
| base | length | 0.8 < meters < 1.5 |
| | width | 0.8 < meters < 1.5 |
| | height | 130 < mm < 230 |
| | max. fork ht. | 80 < mm < 150 |

TABLE 2

Typical Materials for Pallet-Type Containers

| Feature | Element | Material | Process | Structural Details |
|---|---|---|---|---|
| S1, S2 panels | skin | polyolefin, PE | blowmolded | 0.4 < mm < 2.2 wall thickness |
| | insulation | urethane foam | injected | 0.1 mm diam. pores, 20 < mm < 150 thick |
| superbase | skin | polyolefin, PE | blowmolded | 0.4 < mm < 2.2 wall thickness |
| | insulation | urethane foam | injected | 0.1 mm diam. pores, 20 < mm < 150 thick |
| base | frame | polyolefin, PE, PP | injected | 4 < mm < 12 section thickness |
| | insulation | urethane foam | attached | 0.1 mm diam. pores, 20 < mm < 70 thick, deck |
| cover | sheath | film, fabric, nonwoven | formed | surf. coating w. crease lines/zones |
| | core | closed-cell foam | cut sheet | foldable, segments, strips |
| | sealwing | elastomer | formed | compliant, compressable shaped strips 3 < mm < 15, tapered fin edge extension |

TABLE 3

Typical Yoke and Tang Load Couplings

| Feature | Material | Parameter | Characteristic |
|---|---|---|---|
| tang | polyolefin, PE, PP | (thickness of | 6 < mm < 12 |
| | ABS | section at | 5 < mm < 10 |
| | polyamide, nylon66 | maximum | 5 < mm < 10 |
| | polycarbonate | load stress) | 5 < mm < 10 |
| yoke | polyolefin, PE, PP | (thickness of | 6 < mm < 12 |
| | ABS | section at | 5 < mm < 10 |
| | polyamide, nylon66 | maximum | 5 < mm < 10 |
| | polycarbonate | load stress) | 5 < mm < 10 |

values for pallet-type containers. For two-high stacking in truck transport, an alternative base configuration with edge-alignment features and wide edge flanges for spreading the compression load would be needed for loads of more than 300 kg in the upper unit.

EXAMPLE 2

Alternative Materials for Base, Panels, Edgelok Couplings, Insulation, Plicated Elements, and Slidelatches Table 2. lists a range of typical alternative materials, processes and structural details for typical pallet-type insulated containers. These materials and section-thickness values are also valid for light- and medium-duty containers with minimal insulation values. For heavy-load containers the base, superbase, and wall panels must be prepared from thicker-gauge, high-strength polymers and the injected foam/method must be chosen for strength and impact resistance of the resulting structure rather than thermal conductivity.

Typically, large, flat, rectangular wall panels for superbase and S1, S2 sides up to 75 mm thick are made by blowmolding processes with a wide variety of thermoplastics; other processes such as vacuum forming and compression molding could also be used for thinner, smaller panels and special structures/shapes. By compensating the thickness and size of the parison, the final wall thickness of the blowmolded shells are adjustable over a relatively wide range, i.e., 0.5–5 mm.

Extrusion-type processes are used to form the special-shape sections for the yoke and tang elements of the edgeloks and the slidechannel latches. A wide variety of thermoplastics is used for these sections depending upon strength, cost, and bonding/fastening considerations for assembly. For increased column stiffness to support loading insulated containers 2-high, the edgeloks are prepared with heavier wall sections and deeper channels for engaging the sidewall edges. Thermoplastics with maximal strength and impact toughness are used for containers to transport heavy items or 3-high stacking. Because of the shape and light loading, slidechannel latches can be extruded from any convenient thermoplastic; transparent or special colors/patterns are used to provide a visible indication that the latches are fully engaged.

Plicated couplings between the pivoting panels are molded to the desired serpentine shape using standard elastomers such as SBR, U, FPM, CR, etc. (all ASTM-designations); for maximum tear resistance, fabric reinforcement is also used. TPE compositions is directly extruded to the desired serpentine form as needed for gates and sidewalls.

Sealwing elements are made of synthetic elastomers such as polysiloxane, TPE, polyurethane, etc. Their curved-tip form, 10<radius of curvature, mm<100, and tapered thickness from base to tip, 5<thickness, mm<0.05, allows the use of many alternative molding or extrusion processes.

EXAMPLE 3

Loading of Edgeloks, Posilatches and Resulting Stresses

Table 3. discloses typical materials, shape and dimensional ranges for the edgelok and posilatches, especially the yoke, and tang features for a pallet-type embodiment of the insulated chamber of this invention.

Posilatches are mating engagement protrusions on the tang and yoke which require a positive elastic deflection of the yoke and tang. The shape of the camming surfaces, the amount of deflection required to reach full engagement and the amount of residual spring force applied between the yoke and tang at full engagement are all important design factors. For long life and minimal wear between the camming surfaces, the maximum yoke stress during engagement should not exceed about 50 percent of the rupture strength and the long-term residual stress at full engagement should not exceed about 10 percent of the rupture strength. For typical pallet-type containers with wall thickness in the range of 30–45 mm, the yoke deflection during and after engagement are 0.5–0.8 mm and 0.05–0.2 mm respectively.

For a pallet-type container, the sidewalls are a composite of a thick center layer of insulating foam, 30–50 mm thick, covered on both sides by a tough, blowmolded skin, 1–3 mm thick. Sidewall strength in simple flexure is sensitive to the thickness of the blowmolded skin and the shear strength of the foam-skin interface. Assuming the container is loaded with a reinforced bladder filled with liquid such as culture media, the outside faces of the sidewalls will be loaded in tension. One "soft landing" failure mode for avoiding overloading of the container would be to have the sidewalls bow elastically enough to be visually detected before well before the bladder is filled with liquid. Addition of stiffening ribs which extend generally in a lateral or circumferential direction formed into the skin of the outer face of the sidewalls is an effective way of increasing their stiffness toward loads exerted by container contents. Optimally, such external reinforcing ribs would be larger and or more closely spaced toward the top of the sidewalls.

EXAMPLE 4

Thermal Characteristics of Edgeloks and Sidewalls

Equivalent thermal conductivity of the composite superwall and sidewall panels for typical pallet-type applications should fall in the range of 0.02–0.04 W/m-deg. Major thermal shunt paths, such as "kiss zones" of the blowmolded sidewall skin layers where the insulation thickness is zero, must be eliminated or kept to a minimum. In order to achieve overall maximum thermal isolation for the chamber, the insulation injection process can be done in two or more stages to place material with the lowest thermal conductivity at the thinnest insulation zones or at locations of maximum heat flux by all mechanisms combined.

For maximal thermal isolation of the contents in a hot, humid environment, the external surfaces of the base, cover, sidewalls, and superwalls should have a laminated film or coating of IR-reflective material, such as a thin film of aluminum, to reduce radiation heat transfer to a minimum.

EXAMPLE 5

Dewchannel Characteristics and Properties

Dewchannels. Drain paths formed integral with the inside surfaces of sidewalls, superwalls, and base provide a preferred channel to direct the flow of wall condensate away from the container contents and thus prevent contamination. A drop of liquid formed anywhere on the inner surfaces of the insulated container of this invention will be directed along a set of interconnected capillary channels, dewchannels, and into a drainable reservoir pocket formed integral with the base. The dewchannels in the vertical inner faces are formed in fan-like array pointing toward the nearest corner pocket. Dewchannels are formed into the blowmolded inner surface as a narrow capillary slot, 0.1–0.3 mm wide, approximately 2–4 mm deep and the channels are selectively prepared or treated to become hydrophilic, i.e. easily wettable by water. Base dewchannels, which do not depend upon capillary wetting for flow-direction control, can be valleys formed between a fan-like array of ridges extending upward from the top surface of the base and directed generally from the center of the base area and toward a focus at the corners to connect with vertical channels to direct flow downward and into the pockets. Base dewchannels are typically about 3–5 mm wide, 3–10 mm deep and are separated by lands at least 100 mm wide. By positioning the insulated cover at a slight angle, dew collected on its inner surface will be directed to the lowest corners. To allow for extended storage, the volume of each of the 4 base drain pockets should be about 1 liter.

Known plasma treatment methods can be used to prepare local hydrophilic surface areas of polymers i.e., having good wettability by water.

We claim:

1. A transport container comprising:

a base;

a plurality of sidewalls, said sidewalls extending essentially perpendicularly from the base to form a container having an inner cavity;

a plurality of edgelok coupling assemblies for selectively connecting adjacent sidewalls along a detachable extent, said edgelok coupling assemblies including a first edgelok and a second edgelok, said first and second edgeloks designed to be detachably connected to selectively connect adjacent sidewalls, said first edgelok including:

means for securing the first edgelok relative to a side of the sidewall;

a latch member having a latch projection and a latch channel extending along the entire detachable extent; and said second edgelok including:

means for securing the second edgelok relative to a side of an adjacent sidewall; and a latch member having a latch projection and a latch channel extending along the entire detachable extent, the latch projection of the first edgelok being similarly sized and aligned relative to the latch channel of the second edgelok and the latch projection of the second edgelok being similarly sized and aligned relative to the latch channel of the first edgelok so that when the first and second edgeloks are connected, the latch projections of the first and second edgeloks closely fit into said latch channels of second and first edgeloks, respectively, wherein the latch projection of the first edgelok includes a posilatch extension and the latch projection of the second edgelok includes a posilatch groove and the posilatch extension of connected edgeloks fits into the posilatch groove to securely connect the first and second edgeloks of the edgelok coupling assemblies.

2. A transport container comprising:

a base:

a plurality of sidewalls, said sidewalls extending essentially perpendicularly from the base to form a container having an inner cavity;

a plurality of edgelok coupling assemblies for selectively connecting adjacent sidewalls along a detachable extent, said edgelok coupling assemblies including a first edgelok and a second edgelok, said first and second edgeloks designed to be detachably connected to selectively connect adjacent sidewalls, said first edgelok including:

means for securing the first edgelok relative to a side of the sidewall;

a latch member having a latch projection and a latch channel extending along the entire detachable extent; and said second edgelok including:

means for securing the second edgelok relative to a side of an adjacent sidewall; and a latch member having a latch projection and a latch channel extending along the entire detachable extent, the latch projection of the first edgelok being similarly sized and aligned relative to the latch channel of the second edgelok and the latch projection of the second edgelok being similarly sized and aligned relative to the latch channel of the first edgelok so that when the first and second edgeloks are connected, the latch projections of the first and second edgeloks closely fit into said latch channels of second and first edgeloks, respectively, wherein the base and sidewalls include drain paths for draining liquid from an inner cavity of the container, wherein the base includes drain pockets associated with the drain paths of said container and an opening connecting the drain pockets to ambient for releasing fluid from the inner cavity of the container, wherein the opening connecting the drain pockets to ambient includes a check valve.

3. A transport container comprising:

a base;

a plurality of sidewalls, said sidewalls extending essentially perpendicularly from the base to form a container having an inner cavity;

a plurality of edgelok coupling assemblies for selectively connecting adjacent sidewalls along a detachable extent, said edgelok coupling assemblies including a first edgelok and a second edgelok, said first and second edgeloks designed to be detachably connected to selectively connect adjacent sidewalls, said first edgelok including:

means for securing the first edgelok relative to a side of the sidewall;

a latch member having a latch projection and a latch channel extending along the entire detachable extent; and said second edgelok including:

means for securing the second edgelok relative to a side of an adjacent sidewall; and a latch member having a latch projection and a latch channel extending along the entire detachable extent, the latch projection of the first edgelok being similarly sized and aligned relative to the latch channel of the second edgelok and the latch projection of the second edgelok being similarly sized and aligned relative to the latch channel of the first edgelok so that when the first and second edgeloks are connected, the latch projections of the first and second edgeloks closely fit into said latch channels of second and first edgeloks, respectively, wherein the latch members of the first and second edgeloks are formed of U-shaped members, each U-shaped member having two extended legs and a base portion, an extended leg of each U-shaped member forming the latch projection and two extended legs and a base portion of each U-shaped member defining the latch channels, wherein the latch projection of the first edgelok includes a posilatch extension extending from the extended leg into the latch channel and the latch projection of the second edgelok includes a posilatch groove formed on the extended leg, the posilatch extension and posilatch groove being aligned so that the posilatch extension fits into the posilatch groove when first and second edgeloks are connected to securely connect the first and second edgeloks of the edgelok coupling assemblies.

4. The transport container of claim 3 wherein the posilatch extension of the first edgelok and the posilatch groove of the second edgelok are spaced from respective ends of the extended legs of the latch projections.

5. A transport container comprising:

a base;

a plurality of sidewalls, said sidewalls extending essentially perpendicularly from the base to form a container having an inner cavity;

a plurality of edgelok coupling assemblies for selectively connecting adjacent sidewalls along a detachable extent, said edgelok coupling assemblies including a first edgelok and a second edgelok, said first and second edgeloks designed to be detachably connected to selectively connect adjacent sidewalls, said first edgelok including:

means for securing the first edgelok relative to a side of the sidewall;

a latch member having a latch projection and a latch channel extending along the entire detachable extent; and said second edgelok including:

means for securing the second edgelok relative to a side of an adjacent sidewall; and a latch member having a latch projection and a latch channel extending along the entire detachable extent, the latch projection of the first edgelok being similarly sized and aligned relative to the latch channel of the second edgelok and the latch projection of the second edgelok being similarly sized and aligned relative to the latch channel of the first edgelok so that when the first and second edgeloks are connected, the latch projections of the first and second edgeloks closely fit into said latch channels of second and first edgeloks, respectively, wherein the latch projection of the first edgelok is tapered and the latch channel of the second edgelok is tapered.

6. The transport container of claim 5 wherein the latch projection of the first edgelok includes a posilatch circular shaped connector and the latch channel of the second edgelok includes a circular groove wherein the circular shaped connector fits into the circular groove when the first and second edgeloks are connected to securely connect first and second edgeloks of the edgelok coupling assemblies.

7. A transport container comprising:

a base;

a plurality of sidewalls, said sidewalls extending essentially perpendicularly from the base to form a container having an inner cavity;

a plurality of edgelok coupling assemblies for selectively connecting adjacent sidewalls along a detachable extent, said edgelok coupling assemblies including a first edgelok and a second edgelok, said first and second edgeloks designed to be detachably connected to selectively connect adjacent sidewalls, said first edgelok including:

means for securing the first edgelok relative to a side of the sidewall;

a latch member having a latch projection and a latch channel extending along the entire detachable extent; and said second edgelok including:

means for securing the second edgelok relative to a side of an adjacent sidewall; and a latch member having a latch projection and a latch channel extending along the entire detachable extent, the latch projection of the first edgelok being similarly sized and aligned relative to the latch channel of the second edgelok and the latch projection of the second edgelok being similarly sized and aligned relative to the latch channel of the first edgelok so that when the first and second edgeloks are connected, the latch projections of the first and second edgeloks closely fit into said latch channels of second and first edgeloks, respectively, and further including a cover for sealing an opening of the container to the inner cavity comprising:

a relatively rigid portion sized smaller than the opening to the inner cavity of the container; and a flexible sealwing extending about an outer perimeter of the rigid portion, said rigid portion and flexible sealwing being dimensioned slightly larger than the opening for providing a tight seal between the sidewalls of the container and the cover of the container.

8. The transport container of claim 7 wherein the flexible sealwing of the cover is formed of an elastomeric material.

9. The transport container of claim 7 wherein the flexible sealwing of the cover is tapered inwardly from the rigid portion of the cover.

10. A transport container comprising:

a base;

a plurality of sidewalls, said sidewalls extending essentially perpendicularly from the base to form a container having an inner cavity;

a plurality of edgelok coupling assemblies for selectively connecting adjacent sidewalls along a detachable extent, said edgelok coupling assemblies including a first edgelok and a second edgelok, said first and second edgeloks designed to be detachably connected to selectively connect adjacent sidewalls, said first edgelok including:

means for securing the first edgelok relative to a side of the sidewall;

a latch member having a latch projection and a latch channel extending along the entire detachable extent; and said second edgelok including:

means for securing the second edgelok relative to a side of an adjacent sidewall; and a latch member having a latch projection and a latch channel extending along the entire detachable extent, the latch projection of the first edgelok being similarly sized and aligned relative to the latch channel of the second edgelok and the latch projection of the second edgelok being similarly sized and aligned relative to the latch channel of the first edgelok so that when the first and second edgeloks are connected, the latch projections of the first and second edgeloks closely fit into said latch channels of second and first edgeloks, respectively, wherein the means for securing the first and second edgeloks relative to the sides of sidewalls is formed of a U-shaped attachment member having a base and opposed legs, said U-shaped attachment member defining an attachment channel within said base and opposed legs, the extent between opposed legs being sized similar to the width of the sidewalls to provide a frictional fit between the legs of the U-shaped member and the sidewalls to secure the edgeloks relative to the sidewalls, wherein extended ends of the opposed legs of the U-shaped attachment member include attachment flanges extending from the legs and the sides of the sidewalls includes grooves, the grooves of the sidewalls being aligned so that the attachment flanges of the U-shaped attachment member fit into the grooves of the sidewalls to secure the edgeloks relative to the sidewalls.

11. The transport container of claim 10, wherein the sidewalls include upper and lower side panels hingedly connected, sides of adjacent lower side panels being rigidly connected and first and second edgeloks of the edgelok coupling assemblies being attached to the sides of adjacent upper side panels for selectively connecting the upper side panels of adjacent side walls.

12. The transport container of claim 11 wherein the upper and lower side panels of sidewalls of the container are hingedly connected by a flexible elastomeric hinge.

13. The transport container of claim 10 wherein the base and sidewalls include drain paths for draining liquid from an inner cavity of the container.

14. The transport container of claim 13 wherein the base includes drain pockets associated with the drain paths of said container and an opening connecting the drain pockets to ambient for releasing fluid from the inner cavity of the container.

15. The transport container of claim 10 wherein the latch members of the first and second edgeloks are formed of U-shaped members, each U-shaped member having two extended legs and a base portion, an extended leg of each U-shaped member forming the latch projection and the two extended legs and base portion of each U-shaped member defining the latch channel thereon.

16. The transport container of claim 10 wherein the means for securing the first and second edgeloks relative to the sides of sidewalls is formed of a U-shaped attachment member having a base and opposed legs, said U-shaped attachment member defining an attachment channel within said base and opposed legs, the extent between opposed legs being sized similar to the width of the sidewalls to provide a frictional fit between the legs of the U-shaped member and the sidewalls to secure the edgeloks relative to the sidewalls.

17. The transport container of claim 10 wherein the base and sidewalls are formed of a thermally insulating material.

18. The transport chamber of claim 10 wherein the base and sidewalls are formed of an outer polymer molded shell and a thermally insulated foam material is injected into an inner cavity of the molded shell.

19. The transport container of claim 10 wherein at least one sidewall includes a gate hingedly connected relative to the sidewall within a gate opening of said sidewall to pivot between an opened position and a closed position to provide selective access to the inner cavity of the container.

* * * * *

UNITED STATES PATENT AND TRADEMARK OFFICE

CERTIFICATE OF CORRECTION

PATENT NO. : 5,558,241

DATED : SEPTEMBER 24, 1996

INVENTOR(S) : M. CONRAD HUFFSTUTLER, JR., PATRICK E. MEACHAM, MARK W. WALLACE, CARL R. NYBERG

It is certified that error appears in the above-indentified patent and that said Letters Patent is hereby corrected as shown below:

Col. 3, line 1, delete "performed", insert --preformed--

Col. 3, line 19, delete "downward-faring", insert --downward-facing--

Col. 3, line 27, delete "minor", insert --mirror--

Col. 3, line 64, delete "displating", insert --displacing--

Signed and Sealed this

Twenty-first Day of January, 1997

*Attest:*

Bruce Lehman

BRUCE LEHMAN

*Attesting Officer*

*Commissioner of Patents and Trademarks*